US010578261B1

(12) United States Patent
Li

(10) Patent No.: US 10,578,261 B1
(45) Date of Patent: Mar. 3, 2020

(54) LIGHT STRIP

(71) Applicant: GUANGDONG OML TECHNOLOGY CO., LTD, Zhongshan, Guangdong (CN)

(72) Inventor: Xiaoping Li, Guangdong (CN)

(73) Assignee: GUANGDONG OML TECHNOLOGY CO., LTD, Zhongshan (CN)

( * ) Notice: Subject to any disclaimer, the term of this patent is extended or adjusted under 35 U.S.C. 154(b) by 0 days.

(21) Appl. No.: 16/266,002

(22) Filed: Feb. 2, 2019

(51) Int. Cl.
*F21S 4/28* (2016.01)
*F21V 23/06* (2006.01)
*F21Y 115/10* (2016.01)

(52) U.S. Cl.
CPC ..... *F21S 4/28* (2016.01); *F21V 23/06* (2013.01); *F21Y 2115/10* (2016.08)

(58) Field of Classification Search
CPC ..... F21S 4/28; F21S 2/00; F21S 2/005; F21V 23/06; F21K 9/272; F21K 9/275
USPC ..... 362/311.02, 217.01
See application file for complete search history.

(56) References Cited

U.S. PATENT DOCUMENTS 8,313,212 B1 * 11/2012 Mayer ..... F21S 2/005 362/217.13
2012/0218746 A1 * 8/2012 Winton ..... H05B 33/0806 362/219
2016/0334090 A1 * 11/2016 Zanotto ..... F21V 23/06
2018/0219339 A1 * 8/2018 Zhang ..... F21S 4/20

FOREIGN PATENT DOCUMENTS

CN 103672779 A 3/2014
CN 204497483 U 7/2015

* cited by examiner

*Primary Examiner* — William N Harris

(57) ABSTRACT

Light strip is disclosed, which comprises a light strip, wherein the light strip comprises a strip, a light source, a plug and an input line; the plug comprises an end surface, a left side surface, and a right side surface; a first light transmitting layer and a vacant portion, the first light transmitting layer is disposed above the vacant portion, the input line is connected to the left side surface or the right side surface of the plug. The input line is disposed on the left side surface or the right side surface of the plug according to the present disclosure. When it requires to extend the length of the light strips, the end surfaces of the light strips can be seamlessly connected without bending the input line, thus making the light strips easy to install and more beautiful in appearance.

10 Claims, 2 Drawing Sheets

LIGHT STRIP

FIELD OF THE INVENTION

The present disclosure relates to the field of luminaires, and in particular to a light strip.

BACKGROUND OF THE INVENTION

LED light strips are widely used in building contours, steps, booths, bridges, hotels, KTV decorative lighting, various advertising signs, and various large-scale animations, because of the characteristics of flexibility, lightness, pure color and easy installation. When using flexible lamp strips, due to the different usage requirements of various occasions, it is often necessary to splicing a plurality of LED light strips together to extend the length of the LED light strips.

The existing LED light strip mainly comprises a strip, an LED light source disposed in the strip, and a plug disposed at each end of the strip, wherein one end of the plug is connected to the end of the strip to form conductive connection with the LED light source, the other end of the plug is connected with a power input line, and the LED light source is connected to the external power source through the power input line.

Chinese patent CN103672779A discloses a lamp strip connecting assembly and a high-voltage flexible LED light strip with the same. The high-voltage flexible LED light strip comprises a high-voltage light strip, the high-voltage light strip comprising a plurality of light strip units. Each of the light strip unit is provided with a male plug or a female plug at fore and aft ends, and two strip units are connected by the male plug and the female plug; the high-voltage light strip is connected with a power plug, the power plug comprising a plug, a rectifier Bridge stack and a joint connected to the high-voltage light strip. Wherein, the power plug is generally conductively connected with the light strip through the wire. In order to facilitate the electrical connection between the power plug and the light strip to avoid bending of the wire, the power plug and the light strip are on the same straight line, and the wire forms straight line connection between the power plug and the light strip.

Chinese patent CN204497483U discloses an LED flexible light strip anti-reverse anti-pull waterproof connector and an LED flexible light strip, the flexible light strip comprising an input line, an LED flexible strip and an LED flexible strip anti-reverse anti-pull waterproof connector. One end of the input line is connected with the female plug of the LED flexible light strip anti-reverse anti-pull waterproof connector, and the LED flexible strip is connected with the male plug of the LED flexible light strip anti-reverse anti-pull waterproof connector. Wherein, the input line is electrically connected to the LED flexible strip by the LED flexible light strip anti-reverse anti-pull waterproof connector. In order to facilitate the electrical connection between the input line and the LED flexible strip, the input line and the LED flexible strip are on the same straight line. The LED flexible light strip anti-reverse anti-pull waterproof connector forms straight line forms connection between the input line and the LED flexible strip.

Since the existing power input line and the LED light strip are on the same straight line, when the plurality of LED light strips are spliced to realize extending, the power input line needs to be bent to change its direction, so that the LED light strips can be spliced together to realize extending. Wherein, when a plurality of LED light strips are spliced to realize extending, the position of the plug and the power input line is not illuminated, so that when a plurality of LED light strips are spliced together to realize extending, there may be bright-dark area, which affects the appearance.

SUMMARY OF THE INVENTION

The technical problem to be solved by the present disclosure is to provide a light strip with an input line disposed on the side of the plug to facilitate the extension of the light strip.

The technical problem to be solved by the present disclosure is to provide a light strip which has uniform light emission and does not produce a bright-dark area.

In order to solve the above technical problems, the present disclosure provides a light strip, wherein the light strip comprises a strip, a light source, a plug and an input line, the plug comprises an end surface, a left side surface, and a right side surface, a first light transmitting layer and a vacant portion, the first light transmitting layer is disposed above the vacant portion, the input line is connected to the left side surface or the right side surface of the plug, the strip comprises a body and an extension portion, the body comprises a second light transmitting layer and a cavity, the light source is disposed in the cavity, both ends of the body are provided with the extension portion respectively, the extension portion and an end of the light source are disposed in the vacant portion, a light exiting surface of the first light transmitting layer and a light exiting surface of the second light transmitting layer are on the same plane, light projected by the light source is emitted through the light exiting surface of the first light transmitting layer and the light exiting surface of the second light transmitting layer.

As an improvement of the above technical solution, a light transmittance of the first light transmitting layer is 1-3% larger than a light transmittance of the second light transmitting layer.

As an improvement of the above technical solution, the light transmittance of the first light transmitting layer is 1.6% larger than the light transmittance of the second light transmitting layer.

As an improvement of the above technical solution, a thickness of the first light transmitting layer is equal to a thickness of the second light transmitting layer.

As an improvement of the above technical solution, the plug further comprises a groove, the groove is disposed between the end surface and the vacant portion, and the extension portion extends from the vacant portion into the groove to form a connection between the strip and the plug.

As an improvement of the above technical solution, the strip further comprises a light blocking layer, the light blocking layer is disposed on both sides of the body, the light blocking layer is made of a light blocking material.

As an improvement of the above technical solution, the cross-sectional width of the body is gradually decreased from the light exiting surface of the second light-transmitting layer toward the cavity, and the cross-sectional width of the light blocking layer is gradually increased from the light exiting surface of the second light-transmitting layer toward the cavity.

As an improvement of the above technical solution, the input line is electrically connected to the plug by soldering.

As an improvement of the above technical solution, the plug is connected to the end of the strip by bonding.

By implementing the present disclosure, the beneficial effects are as follows:

1. The input line is disposed on the left side surface or the right side surface of the plug according to the present disclosure. When it requires to extend the length of the light strips, the end surfaces of the light strips can be seamlessly connected without bending the input line, thus making the light strips easy to install and more beautiful in appearance.

2. According to the present disclosure, based on cooperation of the first light transmitting layer, the vacant portion, the extension portion and the second light transmitting layer, the light source is disposed under the first light transmitting layer and the second light transmitting layer, the light exiting surface of the first light transmitting layer and the light exiting surface of the second light transmitting layer are on the same plane, and finally the light emitted by the light source is emitted through the light exiting surface of the first light transmitting layer and the light exiting surface of the second light transmitting layer, so that both the body of the light strips and the plugs can emit light, thereby achieving continuous light emission of the light strips and preventing the dark area from generating at the position of the plugs when light strips are spliced and extended, 3. The present disclosure adjusts the light transmittance of the first light transmitting layer and the second light transmitting layer such that the light transmittance of the first light transmitting layer is slightly larger than the light transmittance of the second light transmitting layer to eliminate the slight difference of light exiting between the connection portion of adjacent plugs and the strip and realize beautiful light-emitting of the light strip.

DETAILED DESCRIPTION OF THE INVENTION

In order to illustrate the objects, technical solutions and advantages of the present invention more clearly, the present invention will be further described in detail with reference to the accompanying drawings.

Figure 1:
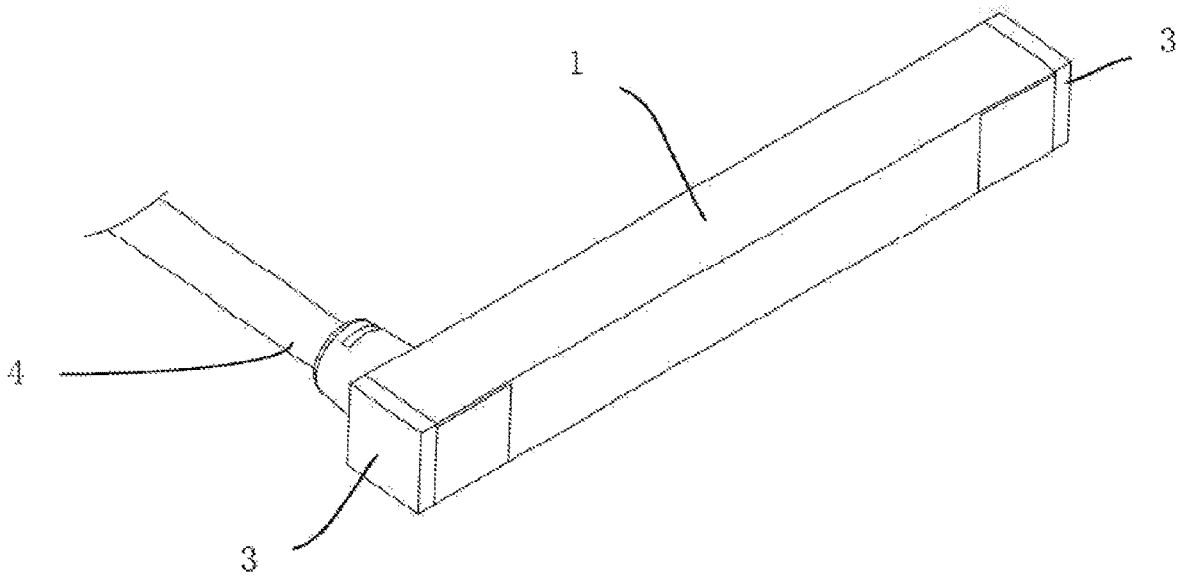
FIG. 1 is a schematic view showing the overall structure of a light strip according to the present disclosure.
Figure 2:
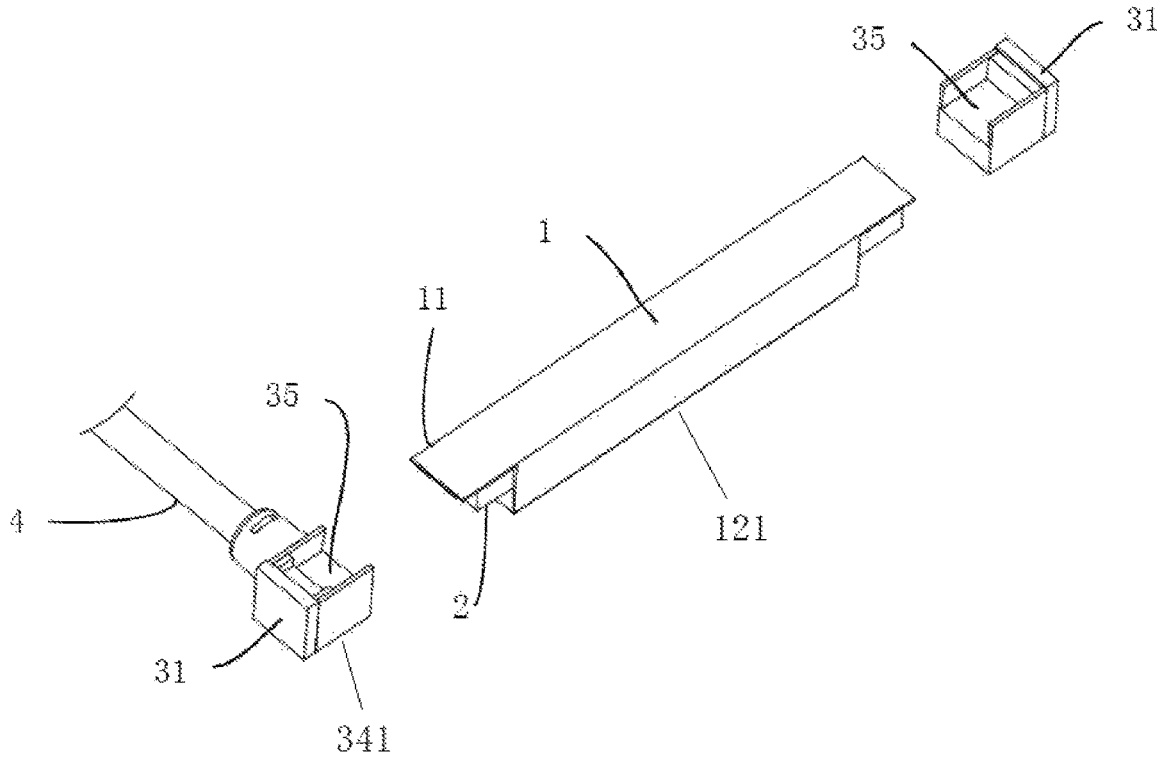
FIG. 2 is an exploded view of a light strip according to the present disclosure.
Figure 3:
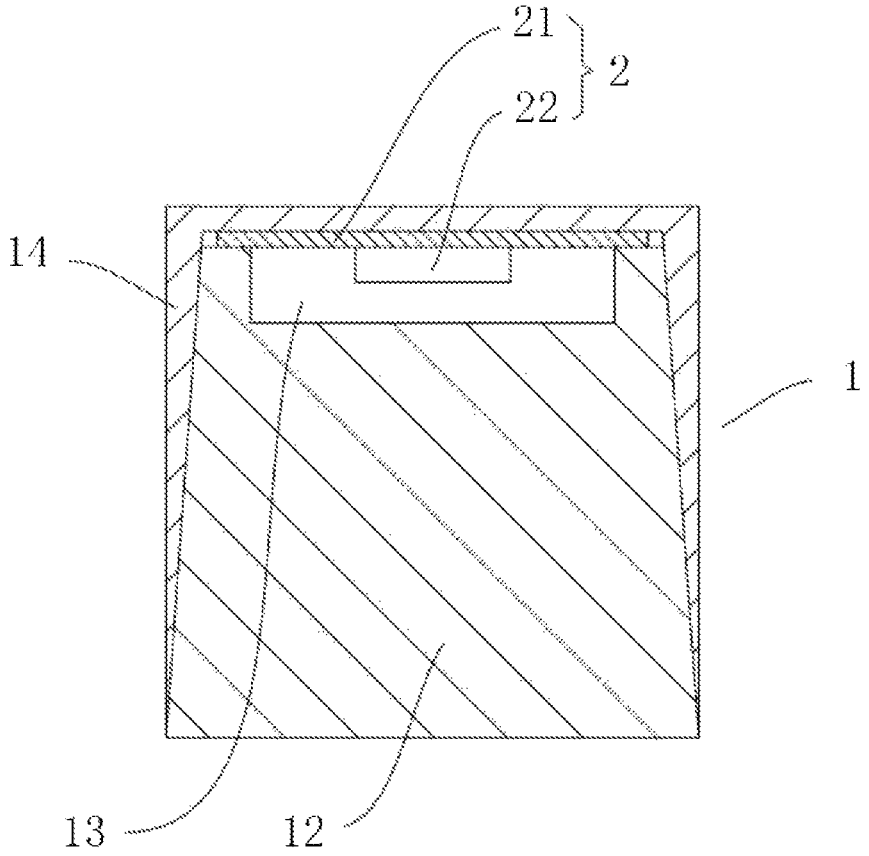
FIG. 3 is a schematic cross-sectional view of a light strip according to the present disclosure.
Figure 4:
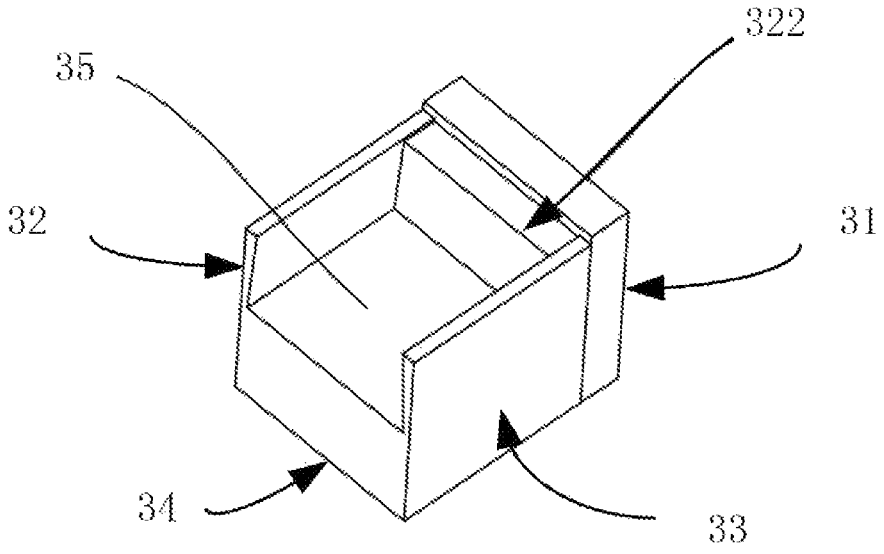
FIG. 4 is a schematic view showing structure of a plug according to the present disclosure.

Referring to FIG. 1 to FIG. 4, a light strip provided by the present disclosure comprises a strip 1, a light source 2, a plug 3 and an input line 4, and the plug 3 comprises an end surface 31, a left side surface 32, and a right side surface 33, a first light transmitting layer 34 and a vacant portion 35. The first light transmitting layer 34 is disposed above the vacant portion 35, and the input line 4 is connected to the left side surface 32 or the right side surface 33 of the plug 3. The strip 1 comprises a body and an extension portion 11. The body comprises a second light transmitting layer 12 and a cavity 13, the light source 2 is disposed in the cavity 13, and both ends of the body are provided with the extending portion 11 respectively. The extension portion 11 and an end of the light source 2 are disposed in the vacant portion 35. A light exiting surface of the first light transmitting layer 341 and a light exiting surface of the second light transmitting layer 121 are on the same plane, and the light emitted by the light source 2 is emitted through the light exiting surface of the first light transmitting layer 341 and the light exiting surface of the second light transmitting layer 121.

Compared with the existing light strip with the input line disposed on the end surface of the plug in the prior art, the input line 4 is disposed on the left side surface 32 or the right side surface 33 of the plug 3 according to the present disclosure. When it requires to extend the length of the light strips, the end surfaces 31 of the light strips can be seamlessly connected without bending the input line 4, thus making the light strips easy to install and more beautiful in appearance.

In addition, according to the present disclosure, in order to enable the spliced extended light strip to continuously emit light and prevent the dark area from generating at the position of the plugs 3 when light strips are spliced and extended, based on cooperation of the first light transmitting layer 34, the vacant portion 35, the extension portion 11 and the second light transmitting layer 12, the light source 2 is disposed under the first light transmitting layer 34 and the second light transmitting layer 12, the light exiting surface of the first light transmitting layer 341 and the light exiting surface of the second light transmitting layer 121 are on the same plane, and finally the light emitted by the light source 2 is emitted through the light exiting surface of the first light transmitting layer 341 and the light exiting surface of the second light transmitting layer 121, so that both the body of the light strips and the plugs 3 can emit light, thereby achieving continuous light emission of the light strips.

Due to the connection portion of the light strips, that is, the interval of two end faces 31 between two adjacent plugs 3, there is still a slight difference of light exiting at the junction of the light strips. To eliminate this difference, the present disclosure adjusts the light transmittance of the first light transmitting layer 34 and the second light transmitting layer 12 such that the light transmittance of the first light transmitting layer 34 is slightly larger than the light transmittance of the second light transmitting layer 12 to eliminate the slight difference of light exiting between the adjacent plugs 3 and the strip 1 and realize beautiful light-emitting of the light strip. Preferably, the light transmittance of the first light transmitting layer 34 is 1-3% larger than the light transmittance of the second light transmitting layer 12. When the light transmittance of the first light transmitting layer 34 is larger than 3% than that of the second light transmitting layer 12, that is, the light transmittance of the first light transmitting layer 34 of the plug 3 is significantly larger than the light transmittance of the second light transmitting layer 12, resulting in the brightness at the plug 3 is significantly greater than the brightness at the strip 1. More preferably, the light transmittance of the first light transmitting layer 34 is 1.6% larger than the light transmittance of the second light transmitting layer 12.

The first light transmitting layer 34 and the second light transmitting layer 12 are made of a light transmitting material, such as glass, silica gel, polystyrene, polymethyl methacrylate, Polydiallyl glycol carbonate, etc., which will not be specifically limited in the present disclosure.

In order to improve the light-emitting effect of the light strip, the thickness of the first light-transmitting layer 34 is equal to the thickness of the second light-transmitting layer 12.

It should be noted that the plug 3 further comprises a groove 322 between the end surface 31 and the vacant portion 35, and the extension portion 11 extends from the vacant portion 35 into the groove 322 to form a connection between the strip 1 and the plug 3. Specifically, both ends of the body are provided with the extending portion 11 respectively, and the extending portion 11 and the second light transmitting layer 12 are parallel to each other. The extension portion 11 extends from both ends of the body of the strip 1 to the vacant portion 35 of the plug 3 to cover the vacant portion 35. In order to achieve a sealed connection between the plug 3 and the strip 1, the plug 3 of the disclosure is connected to the end of the strip 1 by means of bonding. The input line 4 is electrically connected to the plug 3 by means of soldering. Furthermore, the plug 3 is also electrically connected to the light source 2.

When the light strip is installed, the light source 2 passes through the cavity 13 of the strip 1 and the end of the light source 2 is inserted into the vacant portion 35 of the plug 3. The extension portion 11 of the strip 1 passes through the vacant portion 35 and is inserted into the groove 322, and then the strip 1 and the plug 3 are glued to achieve a sealed connection between the two.

In the present disclosure, the plug 3 is bonded to the end of the strip 1, so that there is no need to provide a rubber sealing pad between the plug 3 and the strip 1, and it is not necessary to lock the plug 3 to the strip 1 by a bolt. In the above, the structure of the present disclosure is simplified, and the waterproof sealing performance of the present disclosure can be improved. In addition, the plug 3 and the strip 1 can also be one-piece structure. Specifically, the plug 3 and the light bar 1 can be formed as one-piece by heat welding.

The light source 2 comprises a substrate 21 and at least one LED chip 22 disposed on the substrate 21. The side wall of the cavity 13 is provided with a card slot, and an end of the substrate 21 is inserted into the card slot to fix the substrate 21 in the cavity 13.

In order to improve the light-emitting effect of the light strip, the strip 1 further comprises a light blocking layer 14, both sides of the body are provided with the light blocking layer 14 respectively, and the light blocking layer 14 is made of a light blocking material. According to the present disclosure, both sides of the body are provided with a light blocking layer respectively to prevent light from being emitted from the side wall of the body, so that the emitted light is concentrated and the occurrence of light leakage is reduced. Preferably, the light blocking layer 14 is made of a reflective material, and the light of the sidewall of the body is reflected to the second light-transmitting surface 12 to improve the light-emitting efficiency of the light strip. Specifically, the light blocking layer 14 is made of Ag. Further, the light blocking layer 14 extends from both sides of the body respectively to the bottom of the body.

Preferably, the cross-sectional width of the body is gradually decreased from the light exiting surface of the second light-transmitting layer 121 toward the cavity 13, and the cross-sectional width of the light blocking layer is gradually increased from the light exiting surface of the second light-transmitting layer 121 toward the cavity 13, which facilitates the diffusion of light, thus allowing light to be projected onto larger area.

The second light transmitting layer 12 and the light blocking layer 14 may be one-piece structure. Specifically, the second light transmitting layer 12 and the light blocking layer 14 can be formed as one-piece by heat welding or multi-color co-extrusion.

The above are only preferred embodiments of the present invention, and the scope of the present invention is not limited thereto, and thus equivalent motivations made in the claims of the present invention are still within the scope of the present invention.

What is claimed is:

1. Light strip, wherein the light strip comprises a strip, a light source, a plug and an input line, the plug comprises an end surface, a left side surface, and a right side surface, a first light transmitting layer and a vacant portion, the first light transmitting layer is disposed below the vacant portion, the input line is connected to the left side surface or the right side surface of the plug, the strip comprises a body and an extension portion, the body comprises a second light transmitting layer and a cavity, the light source is disposed in the cavity, both ends of the body are provided with the extension portion respectively, the extension portion and an end of the light source are disposed in the vacant portion, a light exiting surface of the first light transmitting layer and a light exiting surface of the second light transmitting layer are on a same plane, light projected by the light source is emitted through the light exiting surface of the first light transmitting layer and the light exiting surface of the second light transmitting layer.

2. The light strip according to claim 1, wherein a light transmittance of the first light transmitting layer is 1-3% larger than a light transmittance of the second light transmitting layer.

3. The light strip according to claim 2, wherein the light transmittance of the first light transmitting layer is 1.6% larger than the light transmittance of the second light transmitting layer.

4. The light strip according to claim 2, wherein a thickness of the first light transmitting layer is equal to a thickness of the second light transmitting layer.

5. The light strip according to claim 1, wherein the plug further comprises a groove, the groove is disposed between the end surface and the vacant portion, and the extension portion extends from the vacant portion into the groove to form a connection between the strip and the plug.

6. The light strip according to claim 1, wherein the strip further comprises a light blocking layer, the light blocking layer is disposed on both sides of the body, the light blocking layer is made of a light blocking material.

7. The light strip according to claim 6, wherein a cross-sectional width of the body is gradually decreased from the light exiting surface of the second light-transmitting layer toward the cavity, and a cross-sectional width of the light blocking layer is gradually increased from the light exiting surface of the second light-transmitting layer toward the cavity.

8. The light strip according to claim 1, wherein the input line is electrically connected to the plug by soldering.

9. The light strip according to claim 1, wherein the plug is connected to the end of the strip by bonding.

10. The light strip according to claim 3, wherein a thickness of the first light transmitting layer is equal to a thickness of the second light transmitting layer.

* * * * *